US009637910B2

(12) United States Patent
Rubel et al.

(10) Patent No.: US 9,637,910 B2
(45) Date of Patent: May 2, 2017

(54) MODULAR INTERIOR PARTITION FOR A STRUCTURAL FRAME BUILDING

(71) Applicant: Aditazz, Inc., Brisbane, CA (US)

(72) Inventors: Zigmund Rubel, Greenbrae, CA (US); Sungmin Kim, Morgan Hill, CA (US); Ehab Hamouda, San Francisco, CA (US); Nicholas Reid, San Francisco, CA (US); Mark Moore, Richmond, CA (US); Charles Sungwon Han, San Francisco, CA (US); Kale Cushing Wisnia, Sacramento, CA (US)

(73) Assignee: ADITAZZ, INC., Brisbane, CA (US)

( * ) Notice: Subject to any disclaimer, the term of this patent is extended or adjusted under 35 U.S.C. 154(b) by 0 days.

(21) Appl. No.: 15/002,235

(22) Filed: Jan. 20, 2016

(65) Prior Publication Data

US 2016/0208486 A1 Jul. 21, 2016

Related U.S. Application Data

(60) Provisional application No. 62/105,669, filed on Jan. 20, 2015.

(51) Int. Cl.
*E04B 1/00* (2006.01)
*E04B 5/00* (2006.01)
(Continued)

(52) U.S. Cl.
CPC ..... *E04B 1/24* (2013.01); *E04B 2/7457* (2013.01); *E04B 2/821* (2013.01); *E04B 2/766* (2013.01);
(Continued)

(58) Field of Classification Search
CPC ..... E04B 2/7457; E04B 2/821; E04B 2/766; E04B 2/825; E04B 2001/2481; E04B 2001/2484; E04B 1/24; E04B 2/7411
See application file for complete search history.

(56) References Cited

U.S. PATENT DOCUMENTS 5,127,760 A 7/1992 Brady
5,755,066 A 5/1998 Becker
(Continued)

FOREIGN PATENT DOCUMENTS

JP H0734572 A 2/1995
JP 2000355999 A 12/2000

OTHER PUBLICATIONS

International Search Report, PCT/US2012/029119, Mar. 14, 2012.
International Search Report, PCT/US2016/014170, Mar. 28, 2016.

*Primary Examiner* — Brian Mattei

(57) ABSTRACT

An occupiable building and a method for constructing an occupiable space in a structural frame building are disclosed. In an embodiment, an occupiable building includes a structural frame defining a footprint of the occupiable building, at least one lower deck structure located within the footprint of the structural frame and supported by the structural frame, at least one upper deck structure located within the footprint of the structural frame and supported by the structural frame, and an interior partition system installed between the lower deck structure and the upper deck structure to define an occupiable space, the occupiable space having a ceiling. The interior partition system includes first king post assemblies, a lower panel, and an upper panel. The lower panel is fastened to the king post assemblies and to the upper panel. The upper panel is fastened to the king post assemblies and to upper panel.

17 Claims, 20 Drawing Sheets

(51) Int. Cl.

| | |
|---|---|
| ***E04B 7/00*** | (2006.01) |
| ***E04B 1/24*** | (2006.01) |
| ***E04B 2/74*** | (2006.01) |
| ***E04B 2/82*** | (2006.01) |
| *E04B 2/76* | (2006.01) |

(52) U.S. Cl.
CPC ..... *E04B 2/825* (2013.01); *E04B 2001/2481* (2013.01); *E04B 2001/2484* (2013.01)

(56) References Cited

U.S. PATENT DOCUMENTS 5,927,038 A * 7/1999 Goldberg ..... E04B 2/821 403/109.1
6,295,781 B1 10/2001 Thompson
6,412,233 B1 7/2002 Jones
RE39,462 E 1/2007 Brady
2002/0062617 A1 5/2002 deGirolamo et al.
2002/0139079 A1* 10/2002 Brady ..... E04B 2/7457 52/653.1
2003/0145537 A1* 8/2003 Bailey ..... E04B 1/4178 52/210
2004/0003564 A1 1/2004 Surowiecki
2004/0200172 A1 10/2004 Beck et al.
2005/0210798 A1 9/2005 Burg et al.
2006/0096201 A1* 5/2006 Daudet ..... E04B 1/24 52/272
2007/0107325 A1* 5/2007 Klein ..... E04B 2/825 52/126.3
2008/0196337 A1 8/2008 Surowiecki
2009/0019811 A1 1/2009 Goldman
2010/0088970 A1 4/2010 Miller
2010/0146874 A1 6/2010 Brown
2011/0094759 A1 4/2011 Lopes
2011/0252719 A1 10/2011 Wallance
2011/0296769 A1 12/2011 Collins et al.
2011/0296788 A1 12/2011 Cove et al.
2011/0296789 A1 12/2011 Collins et al.
2012/0000149 A1 1/2012 Rice
2012/0066989 A1* 3/2012 Pilz ..... E04B 2/7411 52/232
2012/0233945 A1 9/2012 Rubel
2013/0211795 A1* 8/2013 Vanker ..... G06F 17/5004 703/1
2015/0113896 A1* 4/2015 Pahlmann ..... C09K 21/00 52/317

* cited by examiner

MODULAR INTERIOR PARTITION FOR A STRUCTURAL FRAME BUILDING

CROSS-REFERENCE TO RELATED APPLICATION

This application is entitled to the benefit of provisional U.S. Patent Application Ser. No. 62/105,669, filed Jan. 20, 2015, entitled "Modular Partition Wall Assembly System," which is incorporated by reference herein.

FIELD OF THE INVENTION

The invention relates generally to structural framed buildings, and, more specifically to modular components for structural framed buildings.

BACKGROUND

Structurally framed buildings generally include a steel or concrete frame of columns, girders, and beams that support concrete decks. Once installed, the concrete decks form the base of the various floors of the building. Building systems such as walls, facilities components (e.g., electrical, plumbing, and heating, ventilation, and air conditioning (HVAC) components), and equipment are then attached to the concrete deck to finish out the building. In the construction of structurally framed buildings, partitions may be inserted after placing the decks to create separate rooms or compartments on each deck. The various rooms may be tailored for specific uses depending on the position, size or other attributes of the partitions used for the rooms.

Non-load bearing partitions in the interior of a building provide a separation between spaces within the building without necessarily providing support to the building structure. Partitions may need to be resistant to fire, smoke and/or sound transmittance according to the various requirements and usages of the building. Partitions may be built from the floor of one building deck to the underside of the structural deck overhead in a contiguous manner to create a barrier to meet fire, smoke, and/or sound ratings.

SUMMARY

An occupiable building and a method for constructing an occupiable space in a structural frame building are disclosed. In an embodiment, an occupiable building includes a structural frame defining a footprint of the occupiable building, at least one lower deck structure located within the footprint of the structural frame and supported by the structural frame, at least one upper deck structure located within the footprint of the structural frame and supported by the structural frame, and an interior partition system installed between the lower deck structure and the upper deck structure to define an occupiable space, the occupiable space having a ceiling. The interior partition system includes a first king post assembly fastened to a bottom surface of the upper deck structure and fastened to a top surface of the lower deck structure, wherein the first king post assembly is connected to the bottom surface of the upper deck structure by a top track that allows for vertical deflection, a second king post assembly fastened to the bottom surface of the upper deck structure and fastened to the top surface of the lower deck structure, wherein the second king post assembly is connected to the bottom surface of the upper deck structure by a top track that allows for vertical deflection, a lower panel having a bottom track and a top track and vertical studs connected between the bottom track and the top track, and an upper panel having a bottom track and a top track and vertical studs connected between the bottom track and the top track. The lower panel is fastened to the first king post assembly, to the second king post assembly, and to the upper panel. The upper panel is fastened to the first king post assembly, to the second king post assembly, and to upper panel. The top track of the lower panel and the bottom track of the upper panel are located above the ceiling of the occupiable space.

In an embodiment, the occupiable building includes a first connection plate attached between the first king post, the upper panel, and the lower panel and a second connection plate attached between the second king post, the upper panel, and the lower panel. In a further embodiment, the first and second connection plates include a tab that extends horizontally beyond a face of the respective king post assembly. In a further embodiment, the first and second connection plates each have tabs at one end that bend down vertically to make a connection to the respective king post assembly.

In an embodiment, the occupiable building includes a deflection track fastened to the bottom surface of the upper deck structure between the first and second king post assemblies, wherein the top track of the upper panel is nested in the deflection track.

In an embodiment, the first and second king post assemblies include two vertical metal studs that are fastened back-to-back.

In an embodiment, the first and second king post assemblies are connected to the bottom surface of the upper deck structure by a top track that includes vertical slots that allow for vertical deflection.

In an embodiment, the top track includes vertical slots, wherein the vertical slots are configured to receive a fastener to fasten the top track to the upper panel.

In an embodiment, the lower panel includes a series of parallel vertical studs and wherein the upper panel comprises a series of parallel vertical studs.

In an embodiment, the first and second king post assemblies, the lower panel, and the upper panel are non-load bearing.

In an embodiment, the first and second king post assemblies, the lower panel, and the upper panel form a fire rated interior partition.

In an embodiment, the vertical distance between the lower deck structure and the upper deck structure is in a range of 11-25 feet, the ceiling line is in a range of 7-11 feet, the vertical dimension of the lower panel is in the range of 8-12 feet, and the vertical dimension of the upper panel is in the range of 3-12 feet.

A method for constructing an occupiable space in a structural frame building is disclosed. The structural frame building has a lower deck structure and an upper deck structure and the occupiable space has a ceiling line that defines a ceiling height of the occupiable space within the structural frame building. The method involves installing a first king post assembly between a top surface of the lower deck structure and a bottom surface of the upper deck structure, wherein the first king post assembly is installed in a manner that allows for vertical deflection, installing a second king post assembly between the top surface of the lower deck structure and the bottom surface of the upper deck structure, wherein the second king post assembly is installed in a manner that allows for vertical deflection, installing a lower panel between the first king post assembly, the second king post assembly, and the top surface of the lower deck structure, wherein the lower panel has a bottom track and a top track and vertical studs connected between the bottom track and the top track, installing an upper panel between the first king post assembly, the second king post assembly, and the bottom surface of the upper deck structure, wherein the upper panel has a bottom track and a top track and vertical studs connected between the bottom track and the top track, and fastening the top track of the lower panel to the bottom track of the upper panel such that the top track of the lower panel and the bottom track of the upper panel are located above the ceiling of the occupiable space.

In an embodiment, installing the first king stud assembly involves fastening a first top track to the bottom surface of the upper deck structure and then fastening the first king stud assembly to the first top track and installing the second king stud assembly involves fastening a second top track to the bottom surface of the upper deck structure and then fastening the second king stud assembly to the second top track.

In an embodiment, the first top track includes a plurality of vertical slots and the top panel is fastened to the first top track by inserting fasteners through the vertical slots of the first top track and wherein the second top track includes a plurality of vertical slots and the top panel is fastened to the second top track by inserting fasteners through the vertical slots of the second top track.

In an embodiment, the method involves fastening the bottom track of the lower panel to the top surface of the lower deck structure.

In an embodiment, the method involves fastening a deflection track to the bottom surface of the upper deck structure between the first and second king post assemblies and nesting the upper panel under the deflection track.

In an embodiment, the vertical distance between the top surface of the lower deck structure and the bottom surface of the upper deck structure is in a range of 11-25 feet, the ceiling line is in a range of 7-11 feet, the vertical dimension of the lower panel is in the range of 8-12 feet, and the vertical dimension of the upper panel is in the range of 3-12 feet.

Another method for constructing an occupiable space in a structural frame building is disclosed. The structural frame building has a lower deck structure and an upper deck structure and the occupiable space has a ceiling line that defines a ceiling height of the occupiable space within the structural frame building. The method involves fastening a first bottom track to the top surface of the lower deck structure, fastening a first top track to the bottom surface of the upper deck structure, installing a first king post assembly between the first bottom track and the first top track, wherein the first king post assembly is installed in a manner that allows for vertical deflection, fastening a second bottom track to the top surface of the lower deck structure, fastening a second top track to the bottom surface of the upper deck structure, installing a second king post assembly between the second bottom track and the second top track, wherein the second king post assembly is installed in a manner that allows for vertical deflection, fastening a deflection track to the bottom surface of the upper deck structure between the first and second king post assemblies, fastening a first connection assembly to the first king post assembly, the first connection assembly having a tab that extends vertically, fastening a second connection assembly to the second king post assembly, the second connection assembly having a tab that extends vertically, after the first and second king post assemblies have been installed, installing a lower panel between the first king post assembly, the first connection assembly, the second king post assembly, the second connection assembly, and the top surface of the lower deck structure, wherein the lower panel has a bottom track and a top track and vertical studs connected between the bottom track and the top track, after the first and second king post assemblies have been installed, installing an upper panel between the first king post assembly, the first connection assembly, the second king post assembly, the second connection assembly, and the bottom surface of the upper deck structure, wherein the upper panel has a bottom track and a top track and vertical studs connected between the bottom track and the top track and wherein the top track of the upper panel is nested in the deflection track, and fastening the top track of the lower panel to the bottom track of the upper panel. The top track of the lower panel and the bottom track of the upper panel are located above the ceiling of the occupiable space.

Other aspects and advantages of embodiments of the present invention will become apparent from the following detailed description, taken in conjunction with the accompanying drawings, illustrated by way of example of the principles of the invention.

BRIEF DESCRIPTION OF THE DRAWINGS

Throughout the description, similar reference numbers may be used to identify similar elements. Additionally, in some cases, reference numbers are not repeated in each figure in order to preserve the clarity and avoid cluttering of the figures.

DETAILED DESCRIPTION

Figure 1:
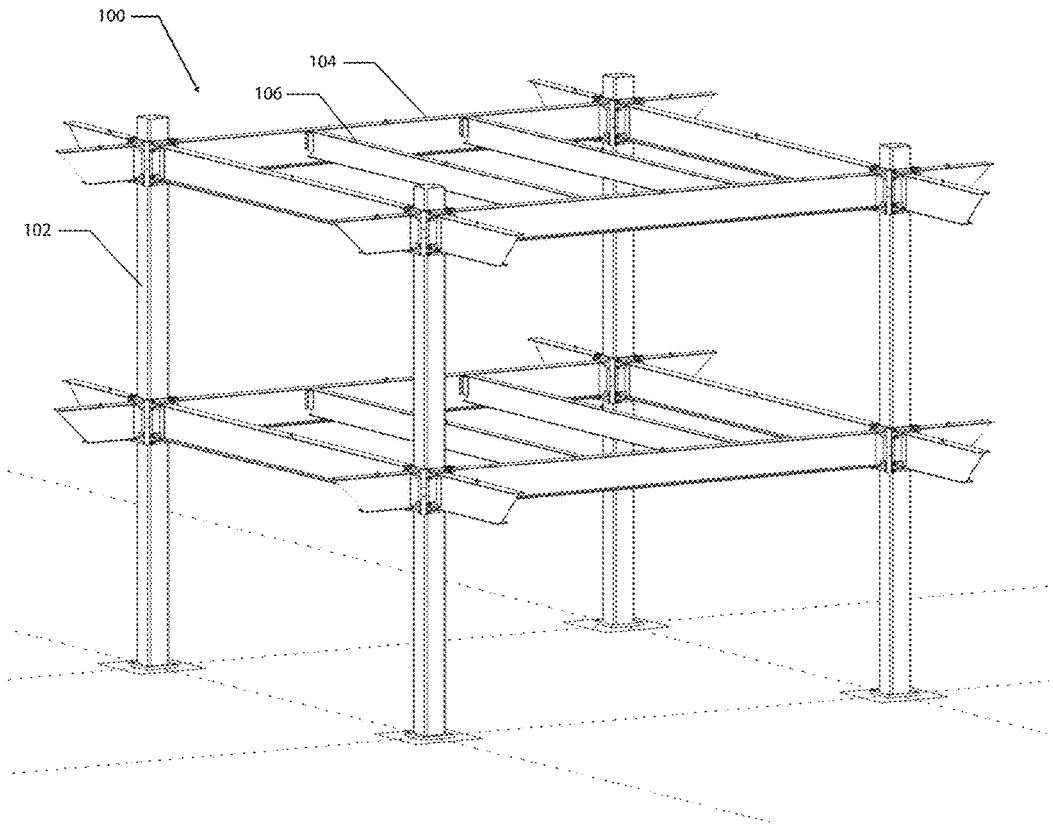
FIG. 1 depicts a perspective view of one embodiment of a structural frame of a framed building.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment. Rather, language referring to the features and advantages is understood to mean that a specific feature, advantage, or characteristic described in connection with an embodiment is included in at least one embodiment. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment. Thus, the phrases "in one embodiment," "in an embodiment," and similar language throughout this specification may, but do not necessarily, all refer to the same embodiment.

While many embodiments are described herein, at least some of the described embodiments present a system and method for constructing an occupiable space in a structural frame building. More specifically, the system is an interior partition system that uses modular partition assemblies to create occupiable spaces on a deck of a structural frame building. In one embodiment, the occupiable spaces are occupied by people and/or objects. The partition assemblies exceed a ceiling height and include king posts, upper panels, and lower panels, where a connecting line between the upper and lower panels is above the ceiling height.

Several variables or issues may affect the construction of a structural frame building. For example, the top portion of a full height wall in the interior of a structural frame building is referred to as the "head of wall condition." The head of wall condition exists at fire, smoke, and/or sound rated walls and because of variations in the design and construction of concrete decks, the head of wall condition may need to be evaluated individually in each steel framed building to ensure that applicable fire, smoke, and/or sound ratings are met. Acoustical properties may be measured using a sound transmission coefficient and correlate to decibel reduction of noise as it is transmitted through a partition. Fire and smoke resistance ratings are properties of time, generally between forty-five minutes and four hours that partitions resist the transmission of fire or smoke from one side of the partition to the other.

Additionally, the anchoring of building systems, such as interior walls, facility components, and equipment to concrete decks is typically customized for each individual structural frame building. Further, the onsite customization of anchoring systems does not typically take into account any future needs and/or uses of the steel frame building.

In some conventional structural frame buildings, partitions are typically "stick" built on site. Coordinating the design of the partitions, internal utility routings, and anchoring/bracing to ensure that the requirements of the many components in combination are met can require tremendous effort. The assembly of the many different components can require valuable resource process time to be expended on each design and construction project that is often lost on future projects and has to be repeated, sometimes with similar errors.

FIG. 1 depicts a plan view of one embodiment of a structural frame 100 of a framed building. The structural frame 100 may include columns 102, which are generally vertical to the surface on which the building sits, and girders 104 and other support beams 106, which are generally horizontal to the surface on which the building sits. Structural frames 100 and framed buildings are well known in the field.

In one embodiment, the structural frames 100 are steel frames. In one embodiment, the columns 102 are "I" shaped steel beams, referred to as "I-beams". In general, the I-beams may be spaced apart in a grid structure that includes an X-span dimension and a Y-span dimension. For example, X and Y spans in the range of 10-70 feet and X and Y spans in the range of 20-40 feet are common, though other dimensions are possible. The structural frames 100 may be any type, shape, or material used for framing the framed building. The material for the framed building may include a composite of more than one material.

The spacing of the girders 104 may be determined by the spacing of the columns 102. The spacing of the beams 106 may be more flexible than the spacing of the girders 104. The beams 106 may be located between pairs of columns 102, and additional beams 106 may be located between columns 102.

Figure 2:
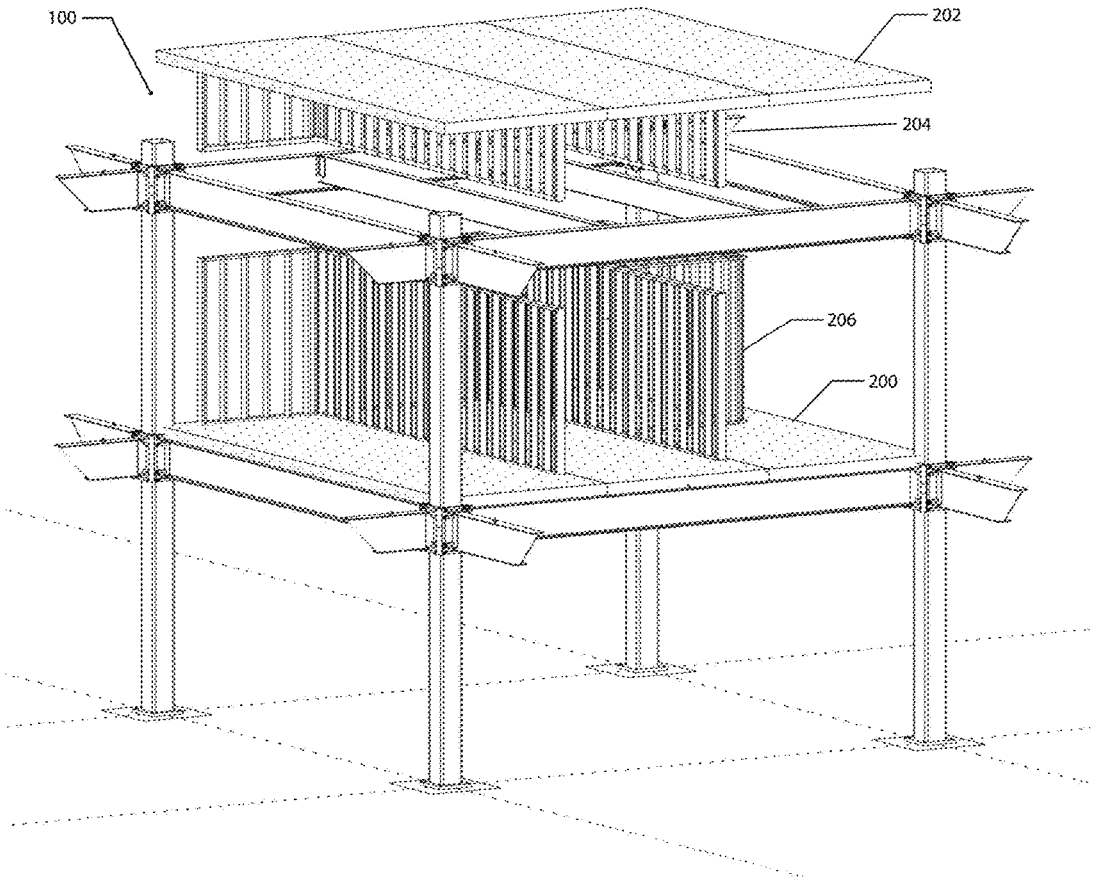
FIG. 2 depicts a perspective view of one embodiment of deck structures in the framed building of FIG. 1.

FIG. 2 depicts a plan view of one embodiment of deck structures in the framed building of FIG. 1. After the structural frame 100 of the framed building has been assembled, the deck structures, also referred to herein as "decks," for the framed building may be installed. In one embodiment, the decks include concrete deck assembly modules that are positioned in accordance with the positioning of the columns 102, girders 104, and beams 106 so that the decks are supported by the structural frame 100.

In one embodiment, the structural frame 100 is a frame that defines a footprint of an occupiable building. The structural frame 100 includes at least one lower deck structure 200 located within the footprint of the frame and at least one upper deck structure 202 located within the footprint of the frame and supported by the building frame. An interior partition system is installed between the lower deck structure 200 and the upper deck structure 202 to define an occupiable space. Partition assemblies may be attached to the upper and lower decks 202, 200 to create occupiable spaces in the framed building. In an embodiment, the interior partition system includes partition assemblies that are not exposed to the outside environment, but are contained within an interior space of the framed building. FIG. 2 depicts an upper portion of a partition assembly 204 and a lower portion of a partition assembly 206. In FIG. 2, the upper deck 202 and the upper portion 204 are shown slightly elevated from the structural frame to provide a more clear view of the elements.

In various embodiments, the concrete decks 200 and 202 may be pre-fabricated and assembled onsite or formed onsite in the structural frame 100. The shape of the decks may be determined by the shape and positioning of the columns 102, girders 104, and beams 106 of the structural frame 100, as well as the location of the decks in the structural frame 100. Additionally, the spacing between the decks may include space for habitation spaces as well as any utility routings, anchors, braces, or other components needed for the operation or structure of the building. In one embodiment, the exact size and shape of the decks is governed in part by at least one of the following parameters: structural performance requirements of the structural frame 100; the framing geometry of the structural frame 100; transportation requirements of the jurisdictions in which the decks are transported on public roads; and vehicle availability for transport.

Figures 3A, 3B, 3C:
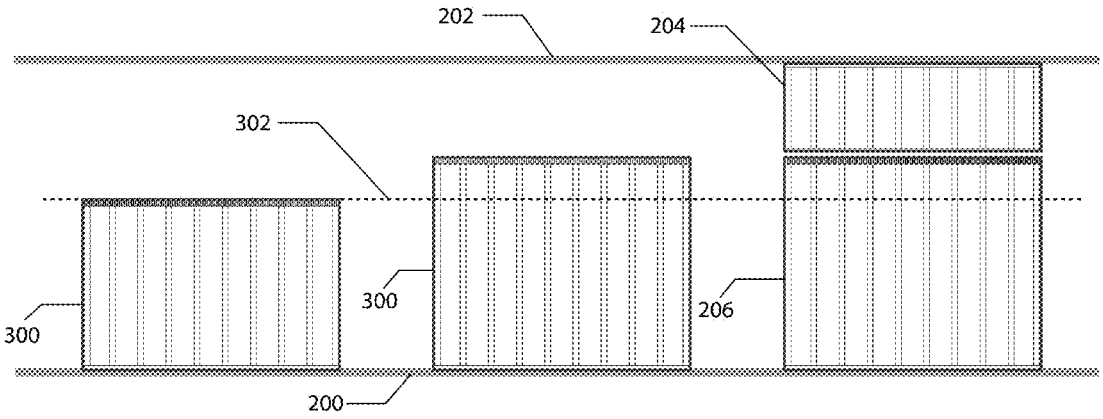
FIGS. 3A-3C depict side views of embodiments of modular partition assemblies between decks in the framed building of FIG. 1.

FIGS. 3A-3C depict side views of embodiments of modular partition assemblies 300 between decks in the framed building of FIG. 1. FIGS. 3A and 3B depict conventional interior partitioning systems that include a single partition assembly. FIG. 3C depicts a modular partitioning system according to the principles described herein.

The interior partitioning system of FIG. 3A has a vertical dimension equal to or approximately equal to a ceiling line 302 between a lower deck 200 and an upper deck 202. The ceiling line 302 may be determined by the structural ceiling visible within the habitation space defined by the partition assemblies. The ceiling line 302 may define a ceiling height of occupiable space within the structural frame building. In an embodiment, the ceiling line 302 is in the range of 8-10 feet from the lower deck 200. For example, a ceiling line 302 at 8 feet is common. The space above the ceiling line 302 and below the upper deck 202 may include utilities, ducts, electrical lines, and/or other components that are not visible from within the habitation space. The interior partitioning system of FIG. 3B has a vertical dimension above the ceiling line 302.

The interior partitioning system of FIG. 3C includes two modular partition assemblies, an upper partition assembly 204 and a lower partition assembly 206. The upper partition assembly 204 is attached to the upper deck 202, the lower partition assembly 206 is attached to the lower deck 200, and the upper partition assembly 204 and the lower partition assembly 206 are attached to each other. In one embodiment, the vertical distance between the lower deck 200 and the upper deck 202 is in the range of 11-25 feet, the ceiling line 302 is in the range of 7-11 feet, the vertical dimension of the lower modular partition assembly is in the range of 8-12 feet, and the vertical dimension of the upper modular partition assembly is in the range of 3-12 feet. In one embodiment, the upper and lower partition assemblies 204, 206 are non-load bearing and form non-load bearing walls. Non-load bearing partitions and/or walls are structures of the framed building that are not necessary to support the structural load of the framed building by conducting weight to a foundation structure of the framed building, though non-load bearing walls may bear some load within the structural frame 100.

In an embodiment, the disclosed modular partition wall assembly is a system of partition walls that can be prefabricated for rapid installation. The system includes a "post and panel" system in which a wall is discretized into both posts and panels. A key to this approach is the installation of king posts (vertical posts) that span from the floor below to the floor above at regular intervals. Following this step, prefabricated wall panels are then put in place and fastened to the king posts. The posts, panels, and connections are all sized to meet strength and stiffness criteria of the respective Building Code agency. In an embodiment, the posts are set at a distance that is no more than the maximum allowable width of an item that is transported on a public road. The posts are set at such a distance so that corresponding prefabricated wall panels have dimensions that allow the prefabricated wall panels to be transported from their point of fabrication to their point of installation.

Figure 4:
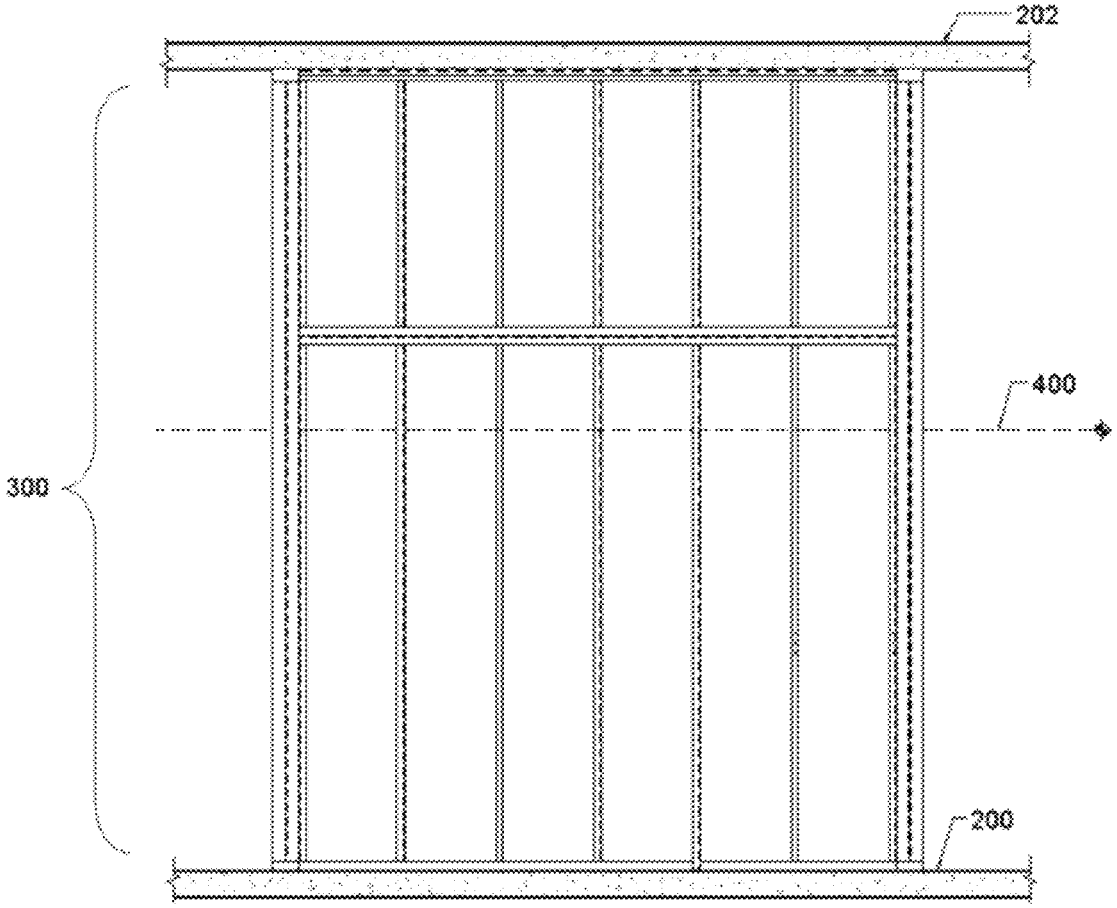
FIG. 4 depicts a side view of an embodiment of a modular partition assembly between a lower floor slab and an upper floor slab in accordance with an embodiment of the invention.

FIG. 4 depicts a side view of an embodiment of a modular partition assembly 300 between the lower floor slab 200 and upper floor slab 202. The ceiling line 400 may be determined by the structural ceiling visible within the habitation space. The ceiling line 400 may define a ceiling height of occupiable space within the building such as in the range of 7-11 feet. The space above the ceiling line 400 and below the upper floor slab 202 may include utilities, ducts, electrical lines, and/or other components that are not visible from within the habitation space.

Figure 5:
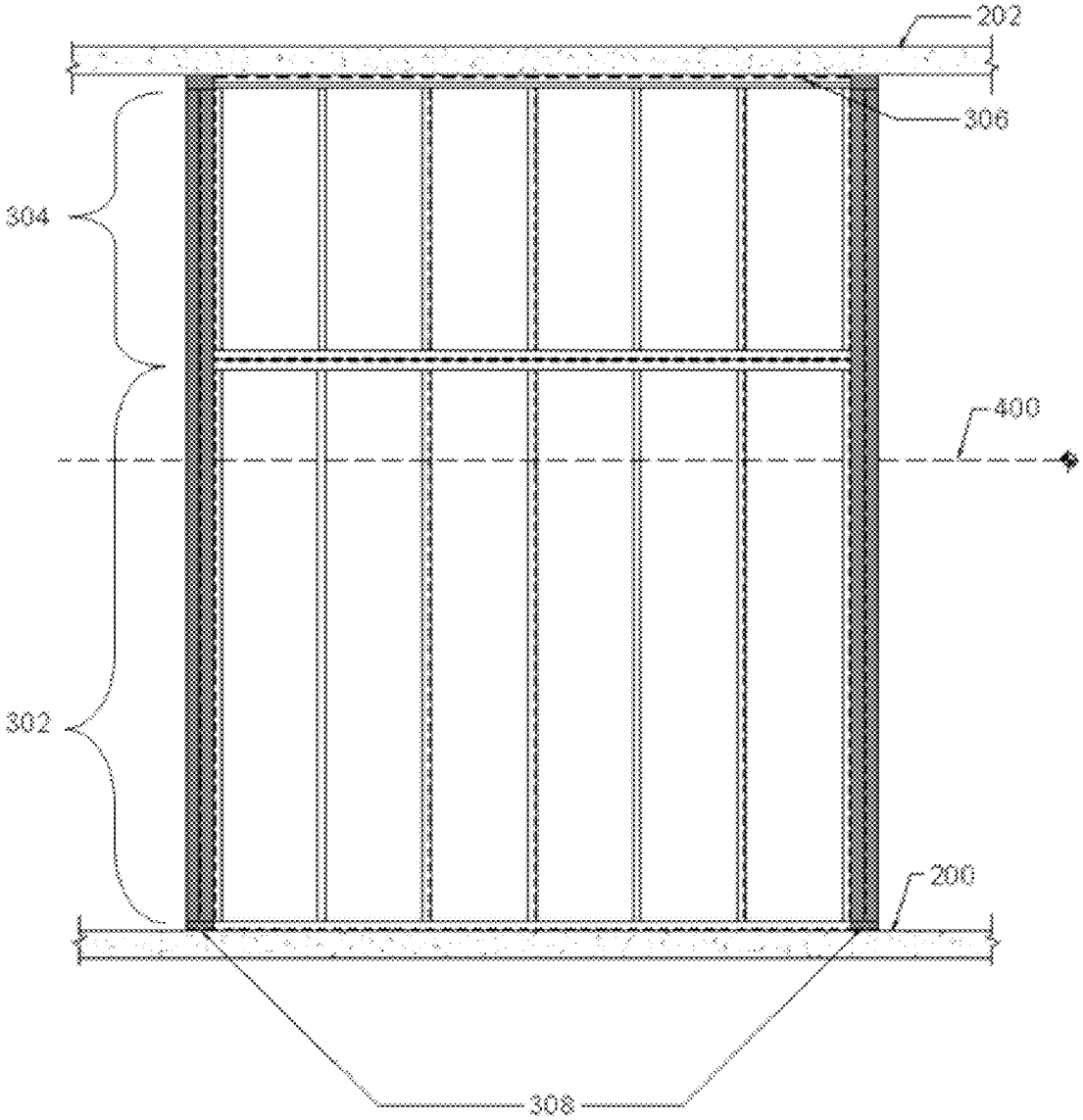
FIG. 5 depicts another side view of the modular partition assembly of FIG. 4 with additional elements identified.

FIG. 5 depicts another side view of the modular partition assembly of FIG. 4 with additional elements identified. The modular partition assembly 300 includes four modular partition assemblies (also referred to as sub-assemblies). The four assemblies shown in FIG. 2 are an upper partition assembly (upper panel) 304, a lower partition assembly (lower panel) 302, and two post assemblies (king post) 308. Two king posts 308 are attached to the floor slab below 200 and to the floor slab above 202. A deflection track 306 is attached to the floor slab above 202. The upper panel 304 is nested into the deflection track 306 and attached to the two king posts 308 on the sides. The lower panel 302 is attached to the floor slab below 200 and attached to the two king posts 308 on the sides. The upper panel 304 is also attached to the lower panel 302.

Figure 6:
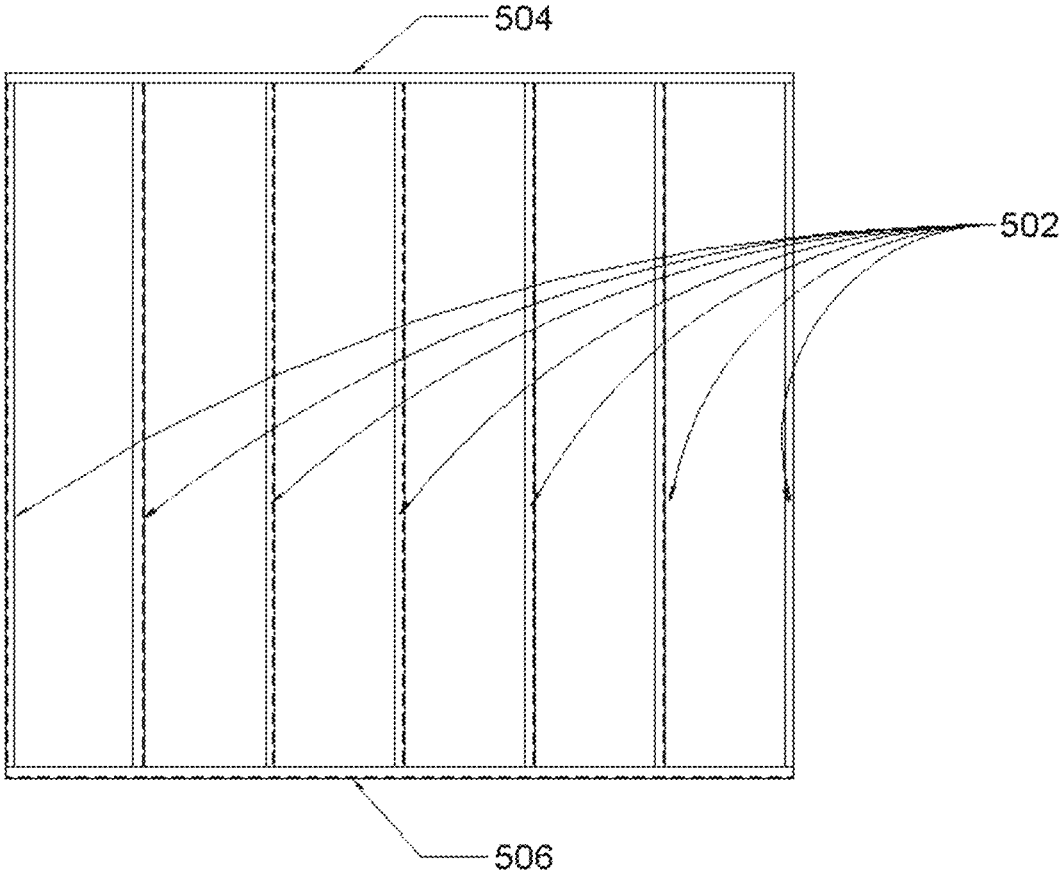
FIG. 6 illustrates an elevation view of the lower panel configuration from FIG. 5.

FIG. 6 illustrates an elevation view of the lower panel 302 configuration of FIG. 5. In an embodiment, this configuration consists of a bottom track 506, a top track 504, and vertical studs 502. In an embodiment, the vertical dimension of the lower panel is from 8-12 feet and the horizontal dimension of the lower panel is a minimum width of 6 inches and a maximum width of 25 feet. In an embodiment, the maximum width dimension is dictated by transportation regulations such that the panels can be transported on public roadways.

Figure 7:
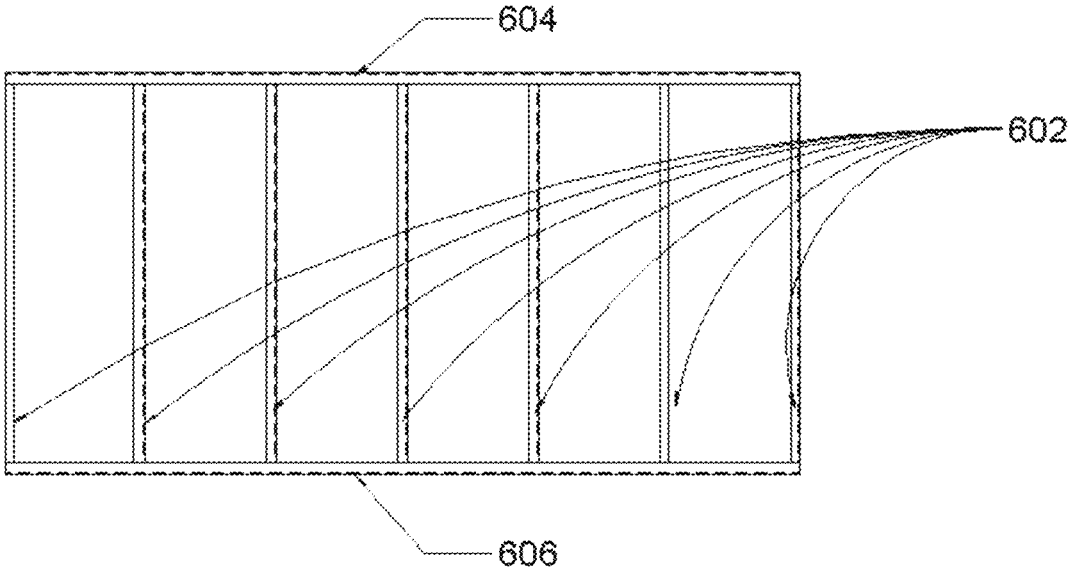
FIG. 7 illustrates an elevation view of the upper panel configuration from FIG. 5.

FIG. 7 illustrates an elevation view of the upper panel 304 configuration from FIG. 5. The upper panel 304 is built similarly to the lower panel 302. In an embodiment, the upper panel 304 configuration consists of a bottom track 606, a top track 604, and vertical studs 602. In an embodiment, the vertical dimension of the upper panel is from 3-12 feet and the horizontal dimension of the upper panel is a minimum width of 6 inches and a maximum width of 25 feet. In an embodiment, the maximum width dimension is dictated by transportation regulations such that the panels can be transported on public roadways.

Figure 8:
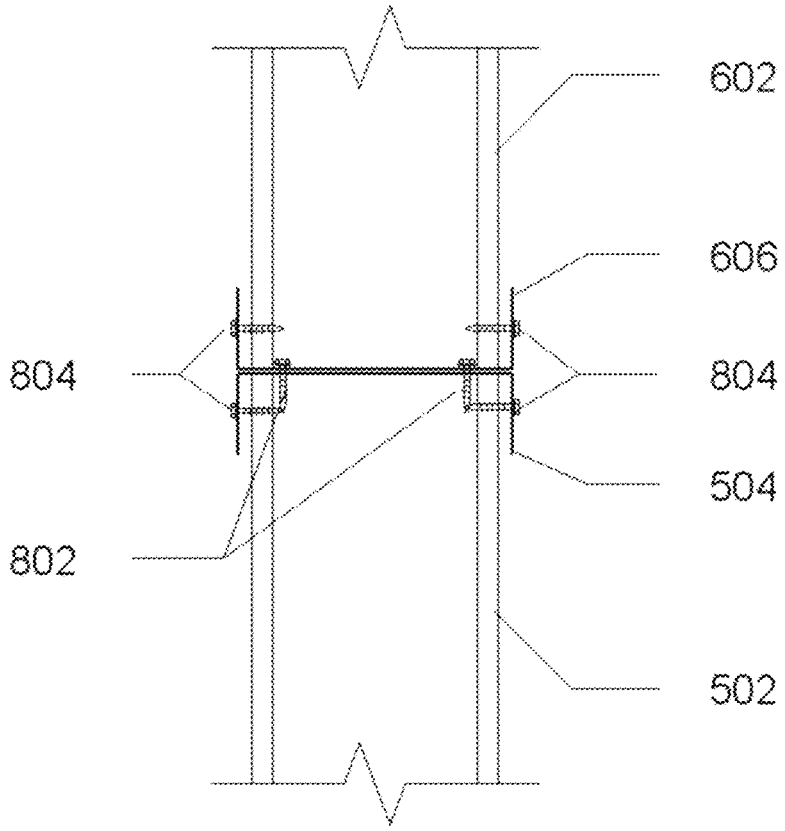
FIG. 8 illustrates an example of a vertical stud connection to the respective track that shows sheet metal screws attached through the sides of the respective tracks and into the vertical studs.

In an embodiment, vertical studs 602 and 502 shown in FIGS. 6 and 7 are attached to their respective tracks 504, 506, 604, and 606 using sheet metal screws on each side of the tracks. FIG. 8 illustrates an example of a vertical stud connection to the respective track that shows sheet metal screws 804 attached through the sides of the respective tracks and into the vertical studs. Other attachment techniques could be used such as spot welding. FIG. 8 also shows the connection between the lower panel 302 and the upper panel 304. In an embodiment, this connection is accomplished by attaching the top track of the lower panel 504 to the bottom track of the upper panel 606 using sheet metal screws 802 spaced at regular intervals along the tracks.

Figure 9:
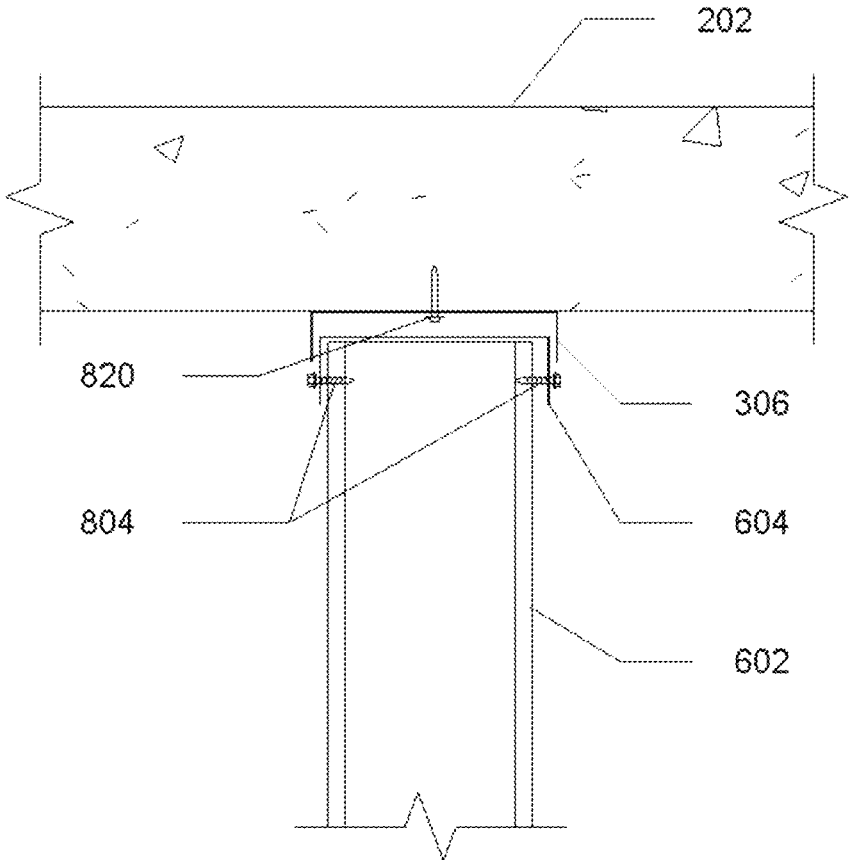
FIG. 9 shows the upper panel connection to the bottom surface of the upper deck structure.

FIG. 9 shows the upper wall panel 304 (FIG. 5) connection to the slab 202 above. A deflection track 306 is fastened to the slab above with power driven fasteners (PDF) 820 at regular intervals along the deflection track 306. The upper panel assembly 304 is then nested into the deflection track 306. As shown in FIG. 9, the nested upper panel is not fastened to the deflection track but rather free floats within the deflection track. The nesting allows the upper panel some freedom to move in the vertical direction to absorb vertical deflection between the upper and lower deck structures.

Figure 10:
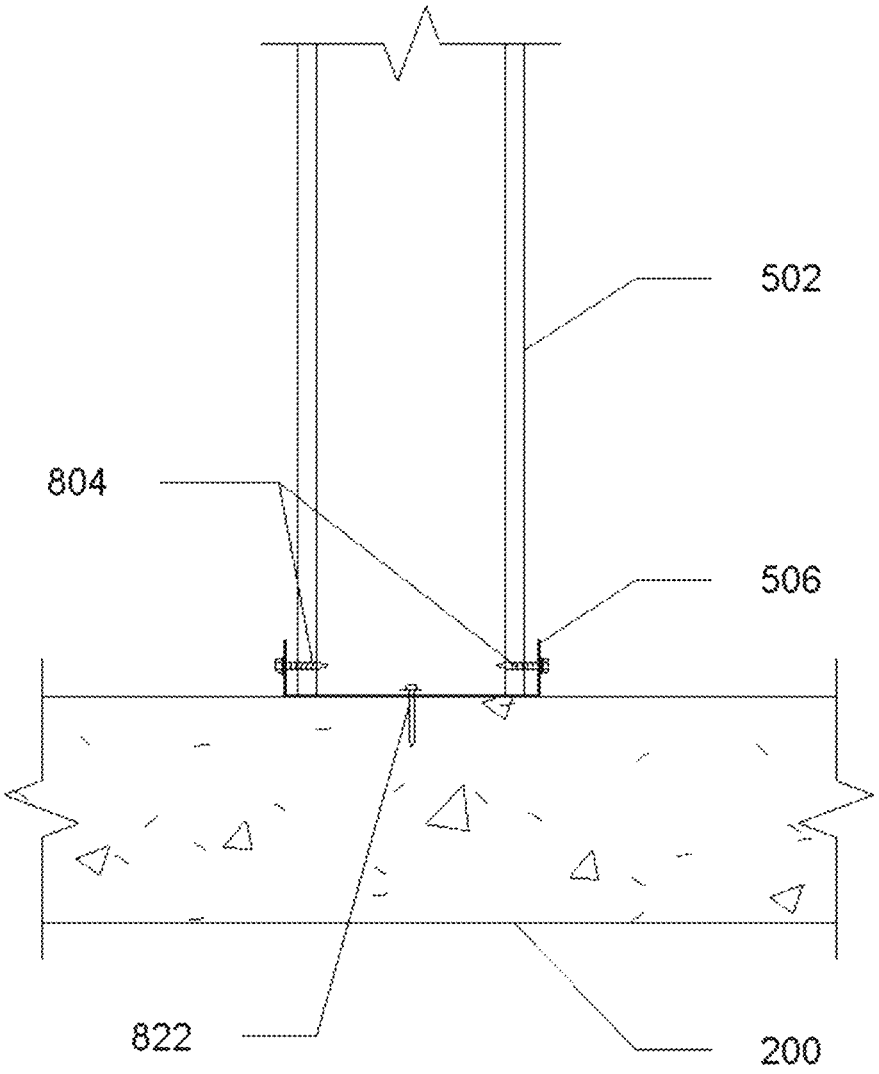
FIG. 10 shows the connection of the lower panel to the top surface of the lower deck structure.

FIG. 10 shows the connection of the lower panel 302 to the bottom floor slab 200. The lower panel bottom track 506 is fastened to the floor slab below 200 with, for example, power driven fasteners 822 on each side of each vertical stud 502.

Figure 11:
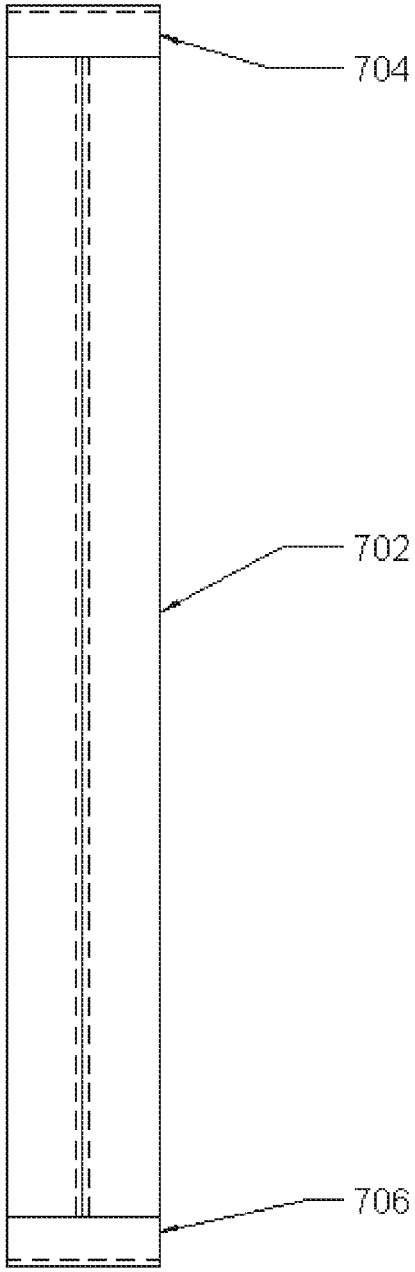
FIG. 11 illustrates an elevation view of a king post assembly.

FIG. 11 illustrates an elevation view of the king post assembly 308 (FIG. 5). In the embodiment of FIG. 11, this configuration consists of back-to-back vertical studs 702, a bottom track 706, and a top track 704. For example, the two studs are fastened back-to-back by screws. In an embodiment, the studs are light-gauge metal studs that are fastened back-to-back by sheet metal screws. In an embodiment, the sheet metal screws are spaced at regular intervals, such as every 12 inches.

Figure 12:
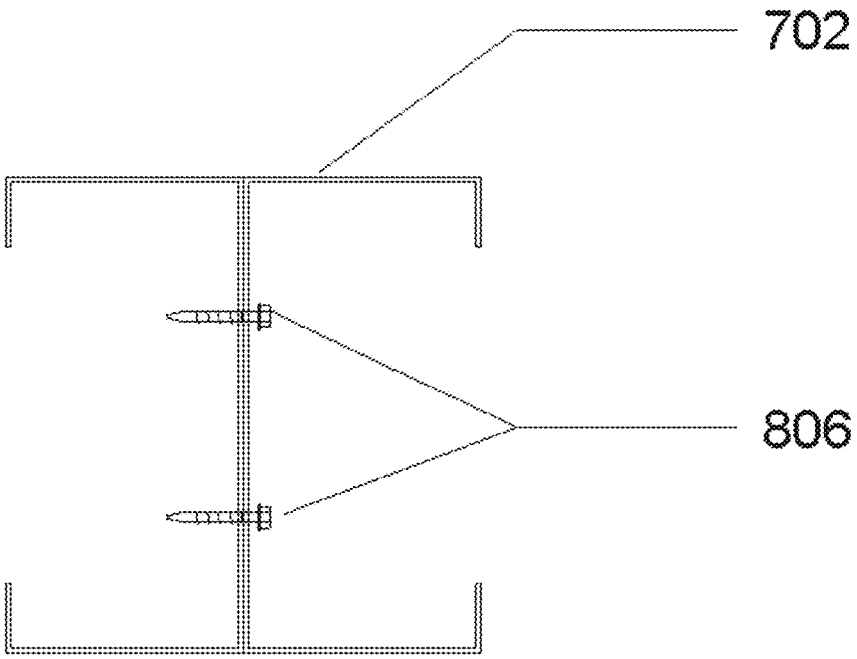
FIG. 12 shows a cut view of the king post assembly from FIG. 11.

FIG. 12 shows a cut view of the king post assembly 308 (FIG. 5) from FIG. 11. The king post assembly consists of two back-to-back, light-gauge metal studs 702. The webs of the studs may be fastened together with sheet metal screws 806 spaced at regular intervals along the studs 702.

Figure 13:
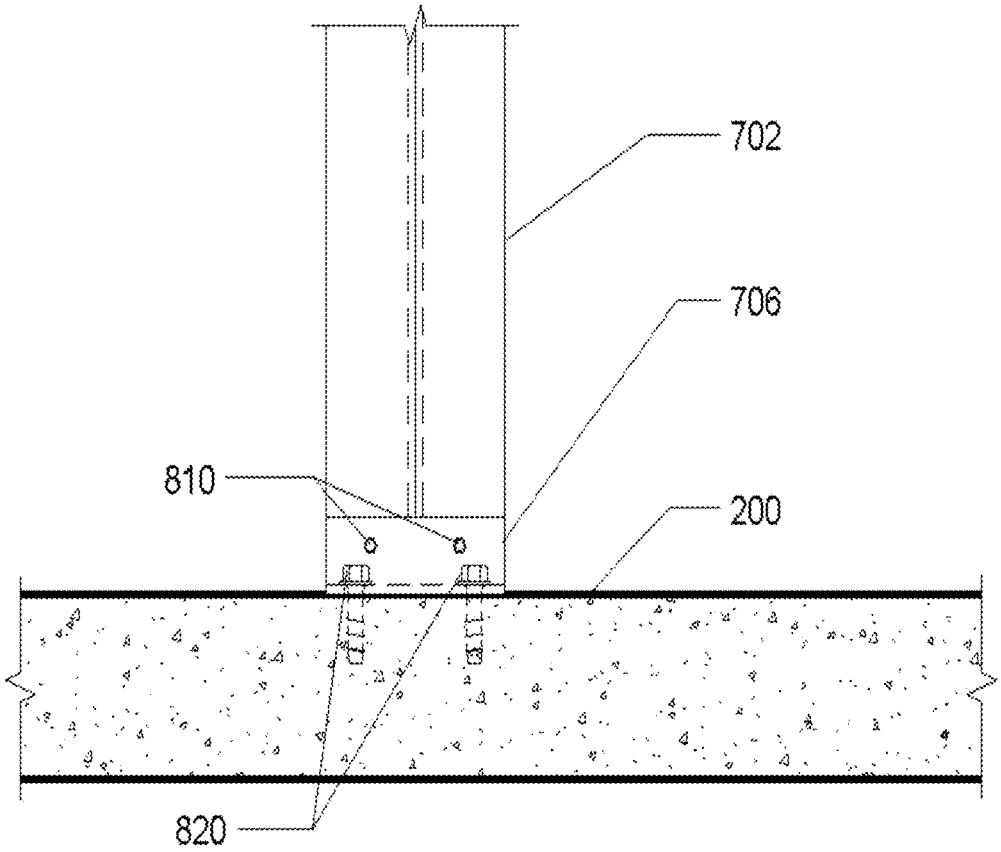
FIG. 13 shows the king post assembly connection to the top surface of the lower deck structure.

FIG. 13 shows the king post assembly 308 (FIG. 5) connection to the lower floor slab 200. The king post bottom track 706 is bolted to the lower floor slab 200 using anchor bolts 820. The anchor bolts 820 are sized to resist the seismic loads with an over strength factor. The bottom track 706 is then nailed to the back-to-back vertical studs 702 (i.e., king posts 308) using sheet metal screws 810 on each side of the bottom track 706.

Figure 14:
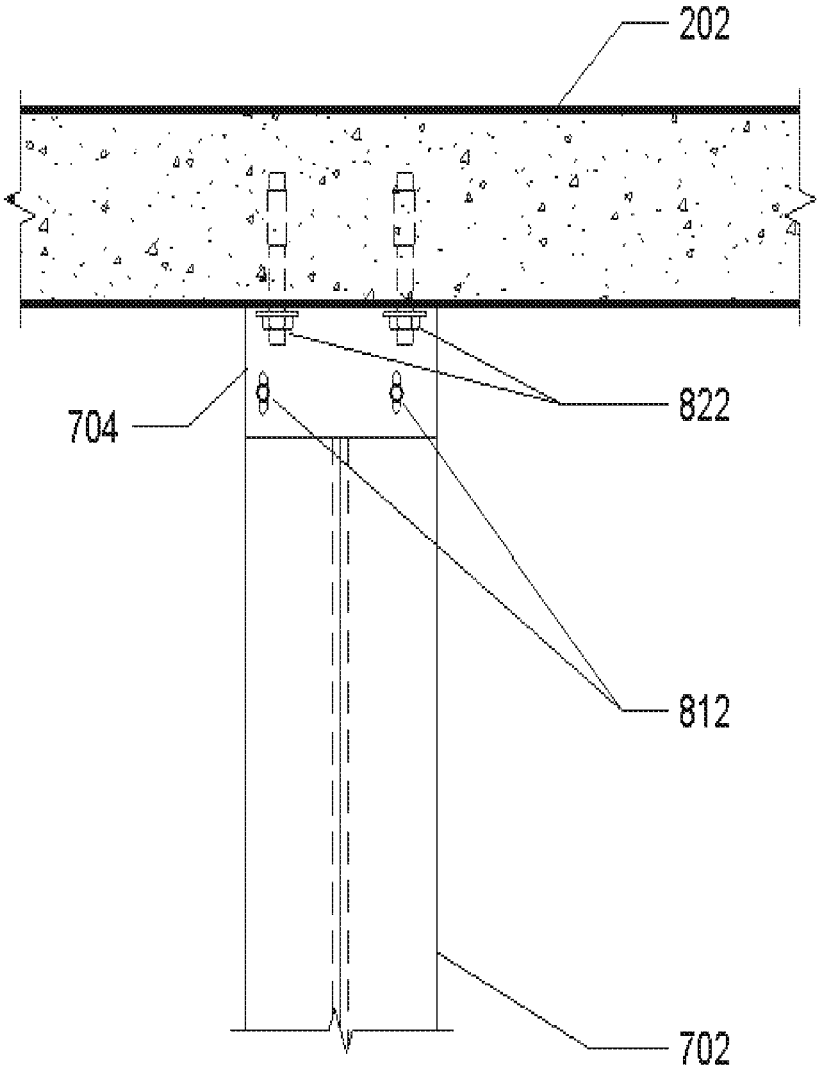
FIG. 14 shows the king post assembly connection to the bottom surface of the upper deck structure.

FIG. 14 shows the king post assembly 308 (FIG. 5) connection to the upper floor slab 202. The king post top track 704 is bolted to the upper floor slab 202 using anchor bolts 822. The anchor bolts 822 are sized to resist the seismic loads with an over strength factor. The top track 704 is then screwed to the back-to-back vertical studs 702 (i.e., the king posts 308) using sheet metal screws 812 on each side of the top track 704. In an embodiment, the top track includes vertical oriented slots (within which the sheet metal screws 812 are placed) that allow for vertical deflection between the upper and lower slabs to be absorbed.

Figure 15A:
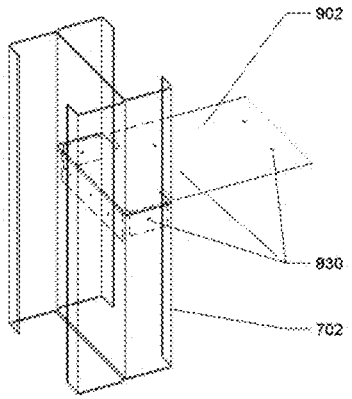
FIGS. 15A-15C show the connection between a king post assembly, an upper panel, and a lower panel using a metal fabricated connection plate.
Figure 15B:
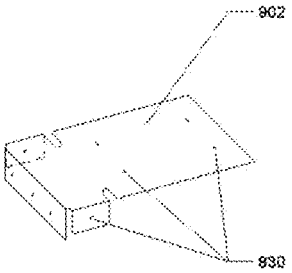
Figure 15C:
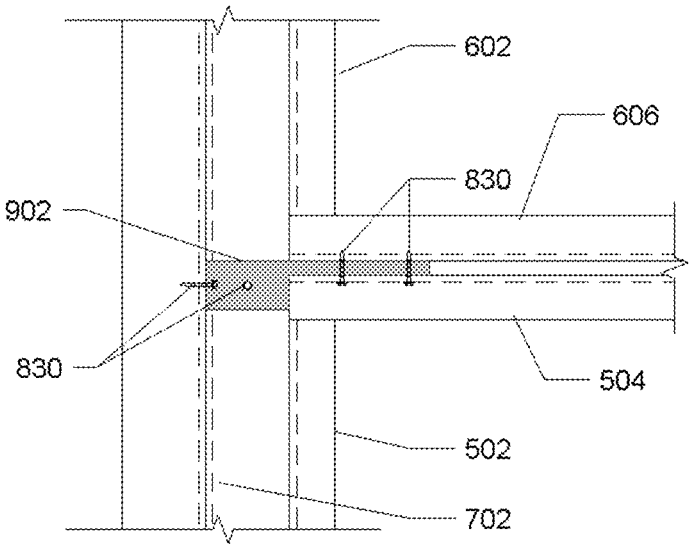

FIGS. 15A-15C show the connection between the king post assembly 308, the upper panel (not shown), and the lower panel (not shown) using a metal fabricated connection plate 902. Referring to FIGS. 15A and 15B, a custom fabricated connection plate 902 is made to fit inside the back-to-back studs 702 of the king post assembly with a tab that extends beyond the face of the outside face. For example, the tab extends horizontally out beyond the perimeter of the king post assembly. The connection plate 902 has tabs at one end that bend down to make the connection to the king post 702 web and flanges. A group of sheet metal screws 830 fasten all three assemblies together (Upper Panel 304, Lower Panel 302, and King Post 308). In an embodiment, the connection plate 902 is pre-attached to the king post 702. With reference to FIG. 15C, the connection plate tab is situated between the top track of the lower panel 504 and the bottom track of the upper panel 606. The sheet metal screws 830 (e.g., track fasteners) penetrate these three members, specifically the top track of the lower panel 504, the connection plate 902, and the bottom track of the upper panel 606.

Figure 16:
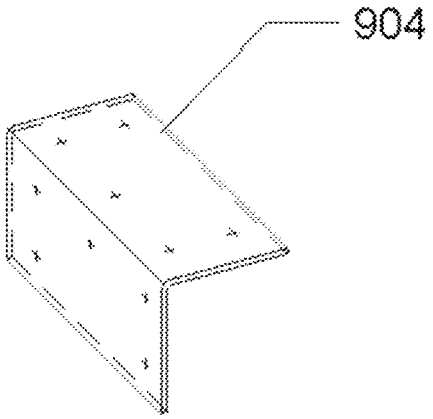
FIG. 16 shows an isometric view of an embodiment of a connection plate for connection to the flat side of a king post assembly.

Another connection plate 904 can be used if the wall panels need to connect to the flat side of the king post assembly. FIG. 16 shows an isometric view of a connection plate for connection to the flat side of a king post assembly. This connection plate works in the same, or similar, way as the other connection plate option 902 shown in FIGS. 15A-15C. For example, the connection plate 904 can be connected to the outer side walls of the king post assembly 308 so that a portion of the connection plate 904 extends on the same plane as the connection plate 902 but offset by 90 degrees.

Figures 17A, 17B, 17C, 17D, 17E:
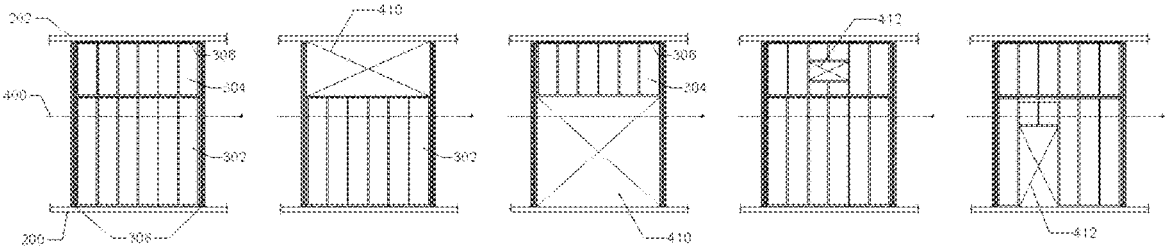
FIGS. 17A-17E show different configurations of the modular interior partition wall assemblies that are possible using the modular system that is described above.

FIGS. 17A-17E show different configurations of the modular interior partition wall assemblies that are possible using the modular system that is described above. FIG. 17A shows a basic configuration with two king posts 308, a lower panel 302, an upper panel 304, and a deflection track 306.

FIG. 17B shows a configuration where only a lower panel 302 is assembled and installed. No upper panel 304 and deflection track 306 is needed in this configuration.

FIG. 17C shows a configuration where only an upper panel 304 and deflection track 306 are needed. No lower panel 302 is needed in this configuration.

Any openings 412 in a wall can be framed using the modular wall system. FIG. 17D and FIG. 17E show examples of typical framing of an opening 412. Opening framing can be done in both the lower panel 302 and the upper panel 306 using traditional framing techniques. FIG. 17E shows a configuration with an opening 412 (e.g., a door) that starts from the bottom floor slab 200.

Figure 18:
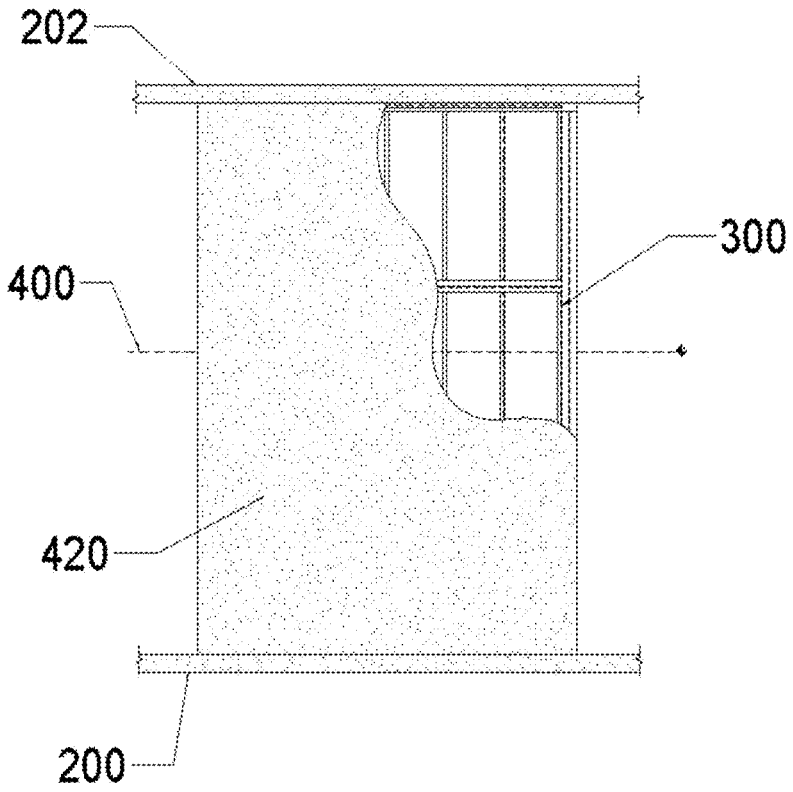
FIG. 18 shows a cut section of gypsum board over a modular wall assembly.

After the modular interior partition wall assembly is assembled and installed within a structural frame 100, the modular interior partition wall assembly can be fitted with any necessary in-wall utilities (e.g., mechanical, electrical, and plumbing equipment, and insulation). Next, the modular interior partition wall assemblies are finished with the appropriate "off-the-shelf" gypsum boards nailed to the wall studs. FIG. 18 shows a cut section of gypsum board 420 over the modular wall assembly 300. Any additional finishes may be added to the gypsum board 420 per client's request, provided that the required fire rating for that wall is achieved. Note: A wall's fire rating may be improved by increasing the number of layers of gypsum board.

Various embodiments of a non-load bearing interior partition system for a structural frame building have been described above. The interior partition system may be used in conjunction with a method for constructing an occupiable space in a structural frame 100 having a lower deck structure 200 and an upper deck structure 202 and having a ceiling line 302 that defines a ceiling height of the occupiable space within the structural frame building.

The following describes a method for assembling a partition wall from modular partition wall components. The method involves:

1. Site layout and location of king post assembly locations.
2. Installation of the bottom track for king post assembly connection to floor slab below, see FIG. 13.
3. Installation of the top track for king post assembly to floor slab above, see FIG. 14.
4. Installation of back-to-back vertical studs between bottom track and top track, see FIGS. 11 and 12.
5. Fasten connection plate to king post assembly, see FIGS. 15A-15C.
6. Installation of deflection track between king post assemblies, see FIG. 9.
7. Installation of the lower panel, if necessary.
   a. Locate lower panel between respective king post assemblies.
   b. Install fasteners from end stud to edge of king post assembly.
   c. Install fasteners from bottom track of lower panel to floor slab below, see FIG. 10.
8. Installation of the upper panel, if necessary.
   a. Locate upper panel between respective king post assemblies and nested under deflection track.
   b. Install fasteners from end stud to edge of king post assembly.
   c. Install fasteners from bottom track of upper panel to top track of lower panel, when necessary, see FIG. 8.
9. Fasten lower panel top track and/or upper panel bottom track to the end connection plates, see FIGS. 15A-15C.

Figure 19:
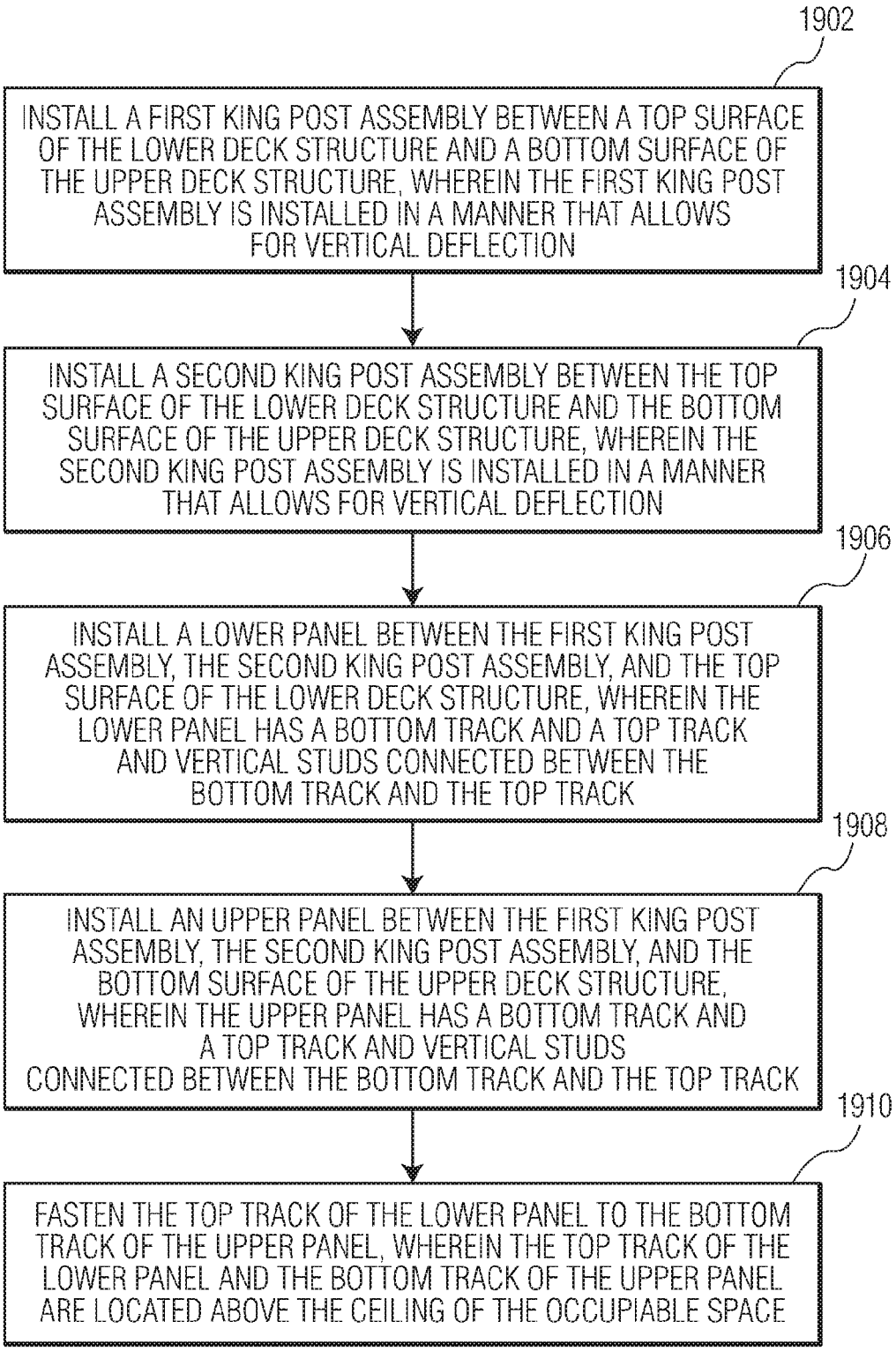
FIG. 19 is a flow diagram of a method for constructing an occupiable space in a structural frame building in accordance with an embodiment of the invention.

FIG. 19 is a flow diagram of a method for constructing an occupiable space in a structural frame building in accordance with an embodiment of the invention. In an embodiment, the structural frame building has a lower deck structure and an upper deck structure and the occupiable space has a ceiling line that defines a ceiling height of the occupiable space within the structural frame building. At block 1902, a first king post assembly is installed between a top surface of the lower deck structure and a bottom surface of the upper deck structure, wherein the first king post assembly is installed in a manner that allows for vertical deflection. At block 1904, a second king post assembly is installed between the top surface of the lower deck structure and the bottom surface of the upper deck structure, wherein the second king post assembly is installed in a manner that allows for vertical deflection. At block 1906, a lower panel is installed between the first king post assembly, the second king post assembly, and the top surface of the lower deck structure, wherein the lower panel has a bottom track and a top track and vertical studs connected between the bottom track and the top track. At block 1908, an upper panel is installed between the first king post assembly, the second king post assembly, and the bottom surface of the upper deck structure, wherein the upper panel has a bottom track and a top track and vertical studs connected between the bottom track and the top track. At block 1910, the top track of the lower panel is fastened to the bottom track of the upper panel and the top track of the lower panel and the bottom track of the upper panel are located above the ceiling of the occupiable space.

Figure 20:
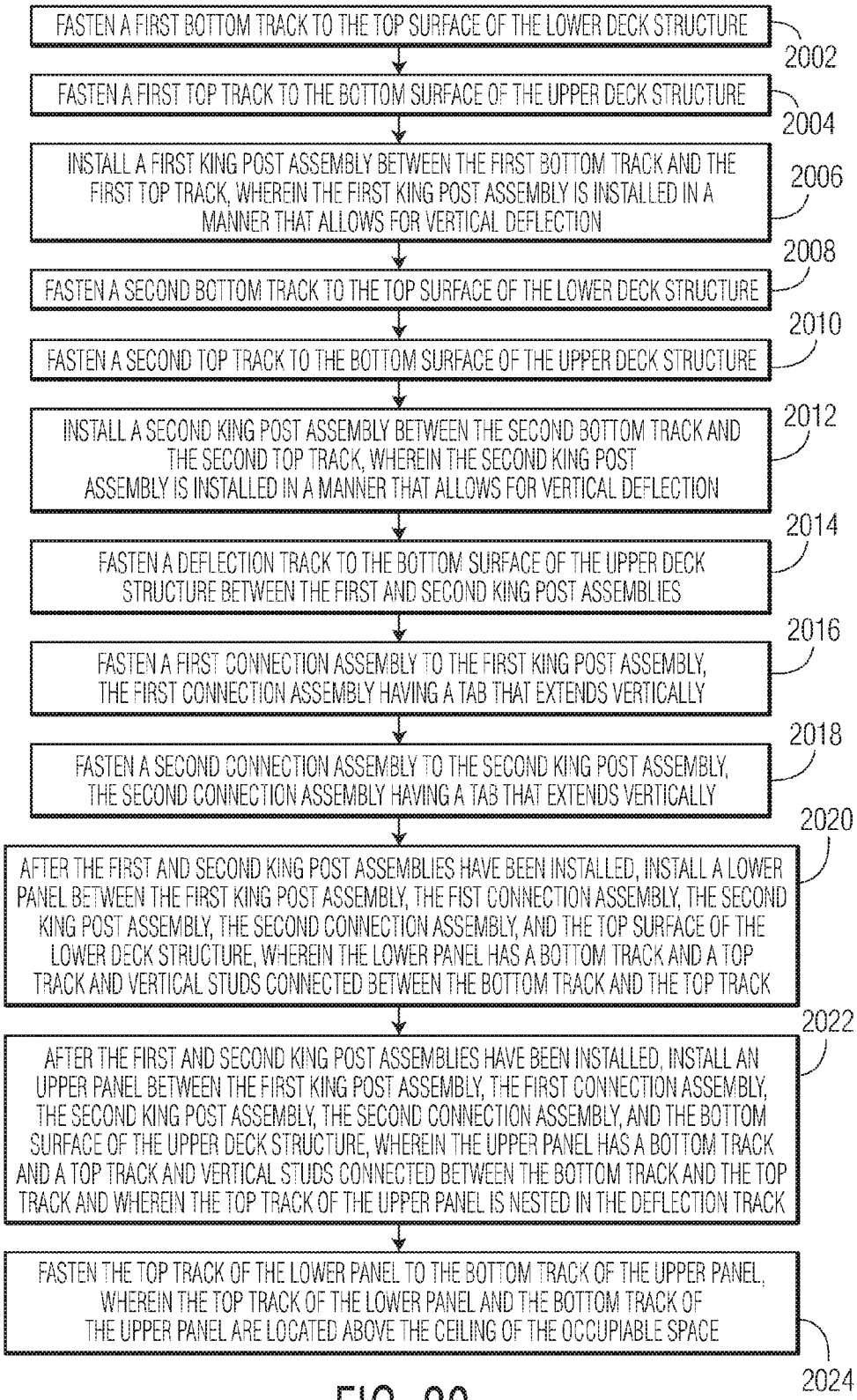
FIG. 20 is a flow diagram of a method for constructing an occupiable space in a structural frame building in accordance with an embodiment of the invention.

FIG. 20 is a flow diagram of a method for constructing an occupiable space in a structural frame building in accordance with an embodiment of the invention. In an embodiment, the structural frame building has a lower deck structure and an upper deck structure and the occupiable space has a ceiling line that defines a ceiling height of the occupiable space within the structural frame building. At block 2002, a first bottom track is fastened to the top surface of the lower deck structure. At block 2004, a first top track is fastened to the bottom surface of the upper deck structure. At block 2006, a first king post assembly is installed between the first bottom track and the first top track, wherein the first king post assembly is installed in a manner that allows for vertical deflection. At block 2008, a second bottom track is fastened to the top surface of the lower deck structure. At block 2010, a second top track is fastened to the bottom surface of the upper deck structure. At block 2012, a second king post assembly is installed between the second bottom track and the second top track, wherein the second king post assembly is installed in a manner that allows for vertical deflection. At block 2014, a deflection track is fastened to the bottom surface of the upper deck structure between the first and second king post assemblies. At block 2016, a first connection assembly is fastened to the first king post assembly, the first connection assembly having a tab that extends vertically. At block 2018, a second connection assembly is fastened to the second king post assembly, the second connection assembly having a tab that extends vertically. At block 2020, after the first and second king post assemblies have been installed, a lower panel is installed between the first king post assembly, the first connection assembly, the second king post assembly, the second connection assembly, and the top surface of the lower deck structure, wherein the lower panel has a bottom track and a top track and vertical studs connected between the bottom track and the top track. At block 2022, after the first and second king post assemblies have been installed, an upper panel is installed between the first king post assembly, the first connection assembly, the second king post assembly, the second connection assembly, and the bottom surface of the upper deck structure, wherein the upper panel has a bottom track and a top track and vertical studs connected between the bottom track and the top track and wherein the top track of the upper panel is nested in the deflection track. At block 2024, the top track of the lower panel is fastened to the bottom track of the upper panel and the top track of the lower panel and the bottom track of the upper panel are located above the ceiling of the occupiable space.

In an embodiment, installing an element may involve placing the element in position and fastening the element to another element. In an embodiment, fastening one element to another element may involve applying a fastening element such as a screw, a nail, and/or an adhesive to physically attached one element to the other element.

While many embodiments are described herein, at least some of the described embodiments present a system and method for constructing an occupiable space in a structural frame building. More specifically, the system is an interior partition system that uses modular partition assemblies to create occupiable spaces on a deck of a structural frame building. In an embodiment, elements of the interior partition system such as the posts and panels are pre-fabricated off-site and assembled into an interior wall at the building site. In an embodiment, elements of the interior partition system are manufactured off-site by machines. In one embodiment, the occupiable spaces are occupied by people and/or objects. The partition assemblies exceed a ceiling height and include upper and lower modular partition assemblies connected to each other at a location above the ceiling height.

In another embodiment, modular partition wall assembly can be used in a bearing-wall joist floor system. In an embodiment, this type of structural system uses a joist floor system supported by load bearing walls such that the load bearing wall is the modular wall system. In an embodiment, the load bearing wall is constructed as described above, and the floor joist is placed on top of a vertical stud of the wall panel system. In an embodiment, such a modular wall system can be used in a "bearing wall-joist" floor system that includes, for example, a 3-story building.

In the above description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

Although specific embodiments of the invention have been described and illustrated, the invention is not to be limited to the specific forms or arrangements of parts so described and illustrated. The scope of the invention is to be defined by the claims appended hereto and their equivalents.

In one embodiment, the interior partition system includes modules that form habitation spaces between the lower deck 200 and the upper deck 202. The modules may be created using modular partition assemblies 300 at one or more sides of the habitation space. In some embodiments, the habitation spaces may have walls formed by a combination of any of load-bearing walls, exterior walls, non-load bearing walls, and interior partition assemblies as described herein.

Modules formed using the interior partition assemblies may be rectangular, square, or a custom shape defined by the partition assemblies. The modules may share walls formed by partition assemblies. In some embodiments, multiple partition assemblies may form a single wall, thus allowing the customization of the size and shape of each module. The modular partition assemblies 300 may include openings 500 for doors, windows, vents or other utilities and components in either the upper or lower partition assemblies 204, 206.

After the modular partition assemblies 300 have been attached to the upper deck 202 and the lower deck 200 and to other modular partition assemblies 300, drywall, plaster, and/or other finishings may be applied to the modular partition assemblies 300, and the structural frame building may be finished. The type of sheathing used to cover the partition assemblies may be dependent on the specific requirements of the structural requirements and/or use of the space that is enclosed by the partition system. The partition assemblies may receive sheet metal backing plates 502 in some embodiments.

In one embodiment, many of the in-wall utilities are placed in the lower partition assemblies, including piping, electric and low voltage services, and other utilities. The utilities may be routed horizontally, vertically, or both horizontally and vertically. Other routing directions may also be used. Larger utility openings and penetrations may be included in the upper partitions assemblies above the ceiling line. The modular partition assemblies may include an anchorage area for wall-hung equipment or accessories, particularly on the lower partition assemblies below the ceiling line. The modular partition assemblies may help streamline overhead mechanical, electrical, and plumbing coordination by providing predictable locations for bracing and other secondary structure members.

In one embodiment, the horizontal spacing of the king posts 308 and vertical studs 502 and 602 is configured such that the partition resists flexural movement in the drywall, as well as the orthogonal deflection in the partition. For example, the horizontal spacing of the vertical studs 502 and 602 may be no more than twenty-four inches on center. In some embodiments, the vertical studs 502 and 602 may be placed directly adjacent to one another proximate an opening in the panel and fastened together to add additional support.

The framing members may be fastened to each other by screwing, pinching, punching or welding the individual pieces based on the structural requirements of the modular partition assemblies 300. Anchoring the partition assemblies to the building structure may be determined based on site-specific needs.

In one embodiment, each modular partition assembly has a minimum width of 6 inches and a maximum width of 25 feet. In some embodiments, partition assemblies having a width wider than 25 feet may require a control joint for proper installation. In one embodiment, each of the upper and lower partition assemblies 304, 306 has a maximum height of 10-20 feet.

The top track 704 accommodates variations in construction tolerances of onsite conditions. The construction of floors on each deck and undersides of decks may have ranges of tolerances that can be as high as 1 inch within 10 feet. In one embodiment, the top track 704 may absorb a range of variation as much as 3 inches.

The top track 704 and deflection track 306 allow for vertical deflection between the upper and lower decks 200 and 202. In one embodiment, deflection includes the movement of one level differentiated by the movement or lack of movement of another floor. For example, one deck may have a live load that causes the entire deck to sag compared to another deck that does not have a similar live load. The difference in loading may cause one of the decks to move and cause deflection/stress in the partition assemblies.

The top track 704 and deflection track 306 may provide predictability in a building life cycle requirement because the receptor joint provides a common height for all partition assemblies and structurally attaches the partition assemblies to the frame structure.

In the above description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

Although specific embodiments of the invention have been described and illustrated, the invention is not to be limited to the specific forms or arrangements of parts so described and illustrated. The scope of the invention is to be defined by the claims appended hereto and their equivalents.

What is claimed is:

1. An occupiable building comprising:

a structural frame defining a footprint of the occupiable building;

at least one lower deck structure located within the footprint of the structural frame and supported by the structural frame;

at least one upper deck structure located within the footprint of the structural frame and supported by the structural frame;

an interior partition system installed between the lower deck structure and the upper deck structure to define an occupiable space, the occupiable space having a ceiling, the interior partition system comprising:

a first king post assembly fastened to a bottom surface of the upper deck structure and fastened to a top surface of the lower deck structure, wherein the first king post assembly is connected to the top surface of the lower deck structure by a first king post bottom track and to the bottom surface of the upper deck structure by a first king post top track that allows for vertical deflection;

a second king post assembly fastened to the bottom surface of the upper deck structure and fastened to the top surface of the lower deck structure, wherein the second king post assembly is connected to the top surface of the lower deck structure by a second king post bottom track and to the bottom surface of the upper deck structure by a second king post top track that allows for vertical deflection;

a lower panel having a bottom track and a top track and vertical studs connected between the bottom track and the top track; and an upper panel having a bottom track and a top track and vertical studs connected between the bottom track and the top track;

wherein the lower panel is fastened to the first king post assembly, to the second king post assembly, and to the upper panel;

wherein the upper panel is fastened to the first king post assembly, to the second king post assembly, and to the lower panel;

wherein the top track of the lower panel and the bottom track of the upper panel are located above the ceiling of the occupiable space.

2. The interior partition system of claim 1 further comprising a first connection plate attached between the first king post assembly, the upper panel, and the lower panel and a second connection plate attached between the second king post assembly, the upper panel, and the lower panel.

3. The interior partition system of claim 2 wherein the first and second connection plates comprise a tab that extends horizontally beyond a face of the respective king post assembly.

4. The interior partition system of claim 3 wherein the first and second connection plates include an additional tab at one end that bends down vertically to make a connection to the respective king post assembly.

5. The interior partition system of claim 1 further comprising a deflection track fastened to the bottom surface of the upper deck structure between the first and second king post assemblies, wherein the top track of the upper panel is nested in the deflection track.

6. The interior partition system of claim 1, wherein the first and second king post assemblies comprise two vertical metal studs that are fastened back-to-back.

7. The interior partition system of claim 1, wherein the first king post top track and the second king post top track include vertical slots that allow for vertical deflection.

8. The interior partition system of claim 1, wherein the lower panel comprises a series of parallel vertical studs and wherein the upper panel comprises a series of parallel vertical studs.

9. The interior partition system of claim 1, wherein the first and second king post assemblies, the lower panel, and the upper panel are non-load bearing.

10. The interior partition system of claim 1, wherein the first and second king post assemblies, the lower panel, and the upper panel form a fire rated interior partition.

11. The interior partition system of claim 1, wherein the vertical distance between the lower deck structure and the upper deck structure is in a range of 11-25 feet, the ceiling line is in a range of 7-11 feet, the vertical dimension of the lower panel is in the range of 8-12 feet, and the vertical dimension of the upper panel is in the range of 3-12 feet.

12. A method for constructing an occupiable space in a structural frame building, the structural frame building having a lower deck structure and an upper deck structure and the occupiable space having a ceiling line that defines a ceiling height of the occupiable space within the structural frame building, the method comprising:

installing a first king post assembly between a top surface of the lower deck structure and a bottom surface of the upper deck structure, wherein the first king post assembly is installed in a manner that allows for vertical deflection, wherein installing the first king post assembly comprises fastening a first king post top track to the bottom surface of the upper deck structure and fastening a first king post bottom track to the top surface of the lower deck structure and then fastening the first king post assembly to the first king post top track and to the first king post bottom track;

installing a second king post assembly between the top surface of the lower deck structure and the bottom surface of the upper deck structure, wherein the second king post assembly is installed in a manner that allows for vertical deflection, wherein installing the second king post assembly comprises fastening a second king post top track to the bottom surface of the upper deck structure and fastening a second king post bottom track to the top surface of the lower deck structure and then fastening the second king stud assembly to the second king post top track and to the first king post bottom track;

installing a lower panel between the first king post assembly, the second king post assembly, and the top surface of the lower deck structure, wherein the lower panel has a bottom track and a top track and vertical studs connected between the bottom track and the top track;

installing an upper panel between the first king post assembly, the second king post assembly, and the bottom surface of the upper deck structure, wherein the upper panel has a bottom track and a top track and vertical studs connected between the bottom track and the top track; and fastening the top track of the lower panel to the bottom track of the upper panel;

wherein the top track of the lower panel and the bottom track of the upper panel are located above the ceiling of the occupiable space.

13. The method of claim 12 wherein the first king post top track comprises a plurality of vertical slots and the first king post assembly is fastened to the first king post top track by inserting fasteners through the vertical slots of the first king post top track and wherein the second king post top track comprises a plurality of vertical slots and the second king post assembly is fastened to the second king post top track by inserting fasteners through the vertical slots of the second top track.

14. The method of claim 12 further comprising fastening the bottom track of the lower panel to the top surface of the lower deck structure.

15. The method of claim 12 further comprising fastening a deflection track to the bottom surface of the upper deck structure between the first and second king post assemblies and nesting the upper panel under the deflection track.

16. The method of claim 12 wherein the vertical distance between the top surface of the lower deck structure and the bottom surface of the upper deck structure is in a range of 11-25 feet, the ceiling line is in a range of 7-11 feet, the vertical dimension of the lower panel is in the range of 8-12 feet, and the vertical dimension of the upper panel is in the range of 3-12 feet.

17. A method for constructing an occupiable space in a structural frame building, the structural frame building having a lower deck structure and an upper deck structure and the occupiable space having a ceiling line that defines a ceiling height of the occupiable space within the structural frame building, the method comprising:

fastening a first king post bottom track to the top surface of the lower deck structure;

fastening a first king post top track to the bottom surface of the upper deck structure;

installing a first king post assembly between the first king post bottom track and the first king post top track, wherein the first king post assembly is installed in a manner that allows for vertical deflection;

fastening a second king post bottom track to the top surface of the lower deck structure;

fastening a second king post top track to the bottom surface of the upper deck structure;

installing a second king post assembly between the second king post bottom track and the second king post top track, wherein the second king post assembly is installed in a manner that allows for vertical deflection;

fastening a deflection track to the bottom surface of the upper deck structure between the first and second king post assemblies;

fastening a first connection assembly to the first king post assembly, the first connection assembly having a tab that extends vertically;

fastening a second connection assembly to the second king post assembly, the second connection assembly having a tab that extends vertically;

after the first and second king post assemblies have been installed, installing a lower panel between the first king post assembly, the first connection assembly, the second king post assembly, the second connection assembly, and the top surface of the lower deck structure, wherein the lower panel has a bottom track and a top track and vertical studs connected between the bottom track and the top track;

after the first and second king post assemblies have been installed, installing an upper panel between the first king post assembly, the first connection assembly, the second king post assembly, the second connection assembly, and the bottom surface of the upper deck structure, wherein the upper panel has a bottom track and a top track and vertical studs connected between the bottom track and the top track and wherein the top track of the upper panel is nested in the deflection track; and fastening the top track of the lower panel to the bottom track of the upper panel;

wherein the top track of the lower panel and the bottom track of the upper panel are located above the ceiling of the occupiable space.

* * * * *